United States Patent [19]

Quarles, Jr.

[11] Patent Number: 5,024,015

[45] Date of Patent: Jun. 18, 1991

[54] LIGHTWEIGHT ARTICULATED ADVERTISING DISPLAY

[76] Inventor: William B. Quarles, Jr., 1133 Dearing Down Dr., Helena, Ala. 35080

[21] Appl. No.: 465,393

[22] Filed: Jan. 16, 1990

[51] Int. Cl.[5] ..... G09F 7/00

[52] U.S. Cl. ..... 40/605; 160/391; 160/DIG. 16

[58] Field of Search ..... 40/605, 606, 647, 648, 40/530–537, 574, 600, 621; 160/135, 351, 391, DIG. 16, 398–404; 52/309.2, 823, , 70, 71, 145, 826, 822, 821, 309.7–309.11; 446/92

[56] References Cited

U.S. PATENT DOCUMENTS

| | | | |
|---|---|---|---|
| Re. 30,777 | 10/1981 | Ytter | 160/135 |
| 3,153,817 | 10/1964 | Pease, Jr. | 52/309.9 |
| 3,348,337 | 10/1967 | Grasso | 52/823 |
| 3,537,200 | 11/1970 | Bubb | 40/605 |
| 3,608,221 | 9/1971 | Harris | 40/605 |
| 3,834,101 | 9/1974 | Wilder et al. | 52/823 |
| 3,889,736 | 6/1975 | Firks | 160/351 |
| 3,942,147 | 3/1976 | Josephson | 40/621 |
| 4,146,999 | 4/1979 | Petrovel et al. | 52/145 |
| 4,722,146 | 2/1988 | Kemeny | 40/605 |

FOREIGN PATENT DOCUMENTS

| | | | |
|---|---|---|---|
| 708336 | 1/1938 | Fed. Rep. of Germany | 52/823 |

*Primary Examiner*—Laurie K. Cranmer
*Assistant Examiner*—James M. Gardner
*Attorney, Agent, or Firm*—Jennings, Carter, Thompson & Veal

[57] ABSTRACT

A portable advertisement display utilizing a plurality of lightweight panels pivotally interconnected by hinges. The panels themselves are constructed of a polystyrene core located intermediate two rigid pressboard panels. Such material is very lightweight but will not accommodate direct connection of hinges. A channel member is secured to selected lateral edges of each panel to provide a stable base on which to connect the hinges. Each panel is sheathed in fabric characteristic of the looped facing of hook-and-loop adhesive material. The panels may be detachably connected in vertical orientation of one another by magnetic strips located on the upper and lower marginal edge of each panel. Advertisement items such as signs or placards are attached to the present invention with strips of fabric characteristic of the hooked portion of hook-and-loop adhesive material.

20 Claims, 3 Drawing Sheets

FIG. 1
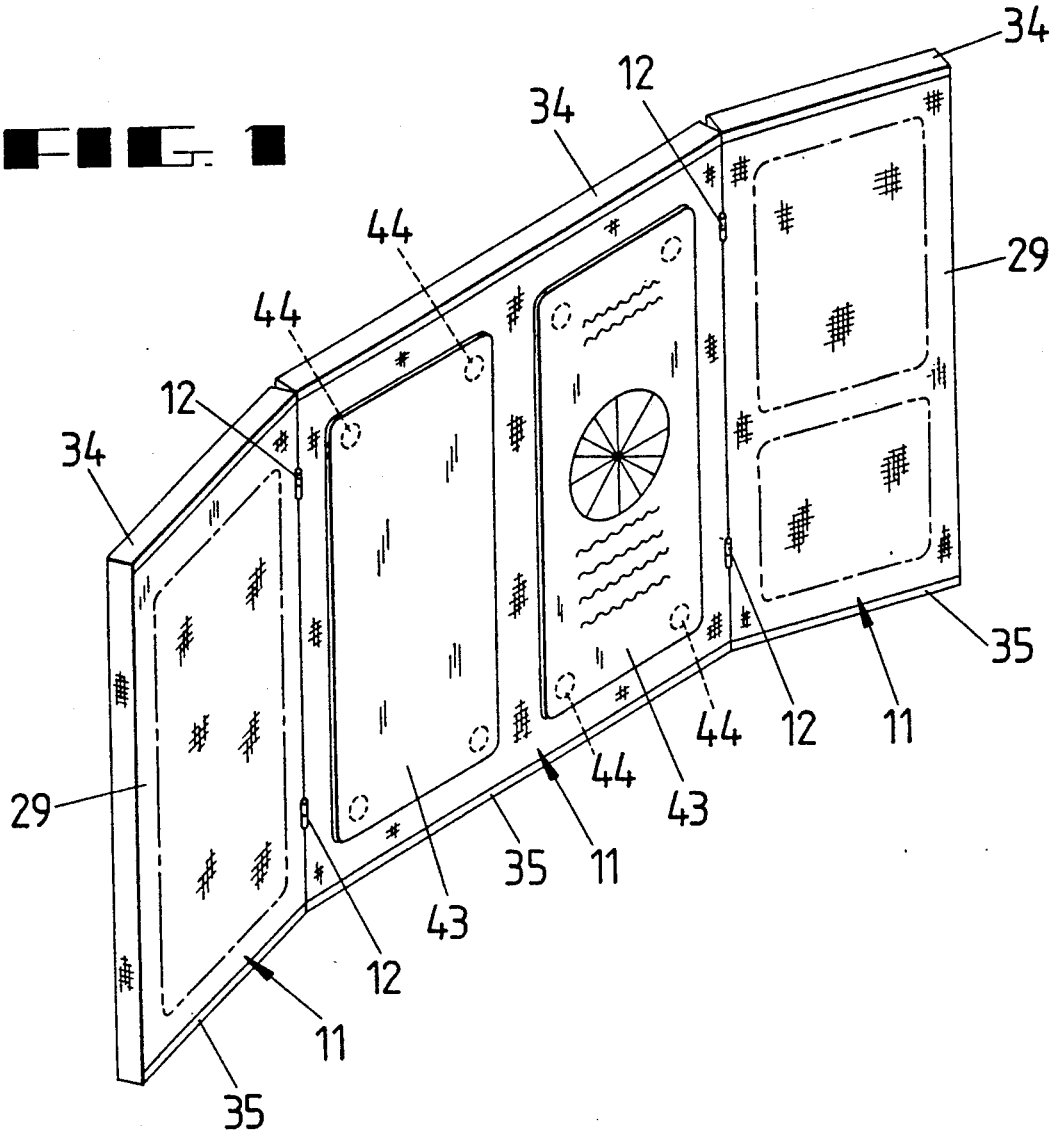
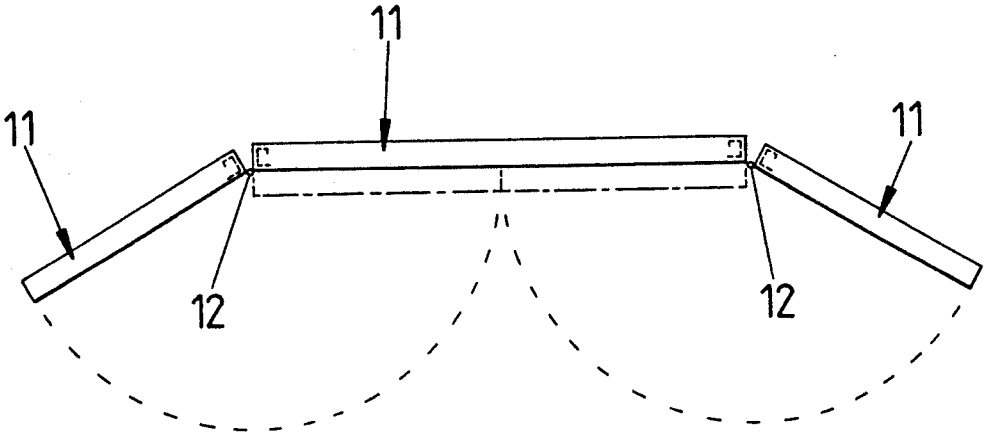
FIG. 2

LIGHTWEIGHT ARTICULATED ADVERTISING DISPLAY

The present invention relates to the field of advertising and more particularly to portable articulated display panels for exhibiting signs, placards and leaflets. In even more particularity the present invention relates to lightweight display panels, generally designed for tabletop use which are laterally interconnected by hinges. In greater particularity the present invention relates to display panels with adhesive surfaces.

BACKGROUND OF THE INVENTION

The use of upright display apparatus for tabletop advertisement is a proven method of conveying information to the public. Easels and bulletin boards are common examples of such displays. The typical articulated tabletop display is generally a heavy and somewhat bulky item to transport. Normally constructed from hardwood or metal, such displays usually require some assembly before use. Displays exist that are made from frames sheathed in cloth or paper and such displays are significantly lighter, however, being constructed of less than durable material, such displays are easily damaged. Lightweight panel material has typically been excluded from the construction of articulated displays because there has been no practical and durable means for attaching hinges to the panel material. Material such as styrofoam or pressboard will not retain hinge screws, rivets or any other conventional means of attachment.

SUMMARY OF THE INVENTION

It is the principal object of the present invention to provide a display panel that is lightweight and collapsible for easy transport.

In support of the principal object, another object of the present invention is to provide an advertising display constructed of lightweight panels laterally interconnected in secured pivotal relation by hinges.

Another object of the invention is to provide an advertisement display that maximizes the amount of display surface available while minimizing the amount of visible frame or other support material.

Still another object of the invention is to provide an advertising display capable of being assembled in a variety of sizes and shapes.

These and other objects and advantages of the present invention are accomplished through the use of a plurality of hinged panels. The panels are constructed of a lightweight polystyrene core located intermediate a pair of rigid outer panels constructed of lightweight pressboard. The panels are hinged on their lateral edges for pivotal movement relative to one another. A channel member is secured along a lateral marginal edge of the panel and provides a durable surface for connection of the hinges.

BRIEF DESCRIPTION OF THE DRAWINGS

Apparatus embodying features of our invention are depicted in the accompanying drawings which form a portion of the disclosure and wherein:

FIG. 1 is a perspective view of the present invention with display items connected thereon;

FIG. 2 is a plan view of the present invention;

DESCRIPTION OF A PREFERRED EMBODIMENT

Figures 3, 7:
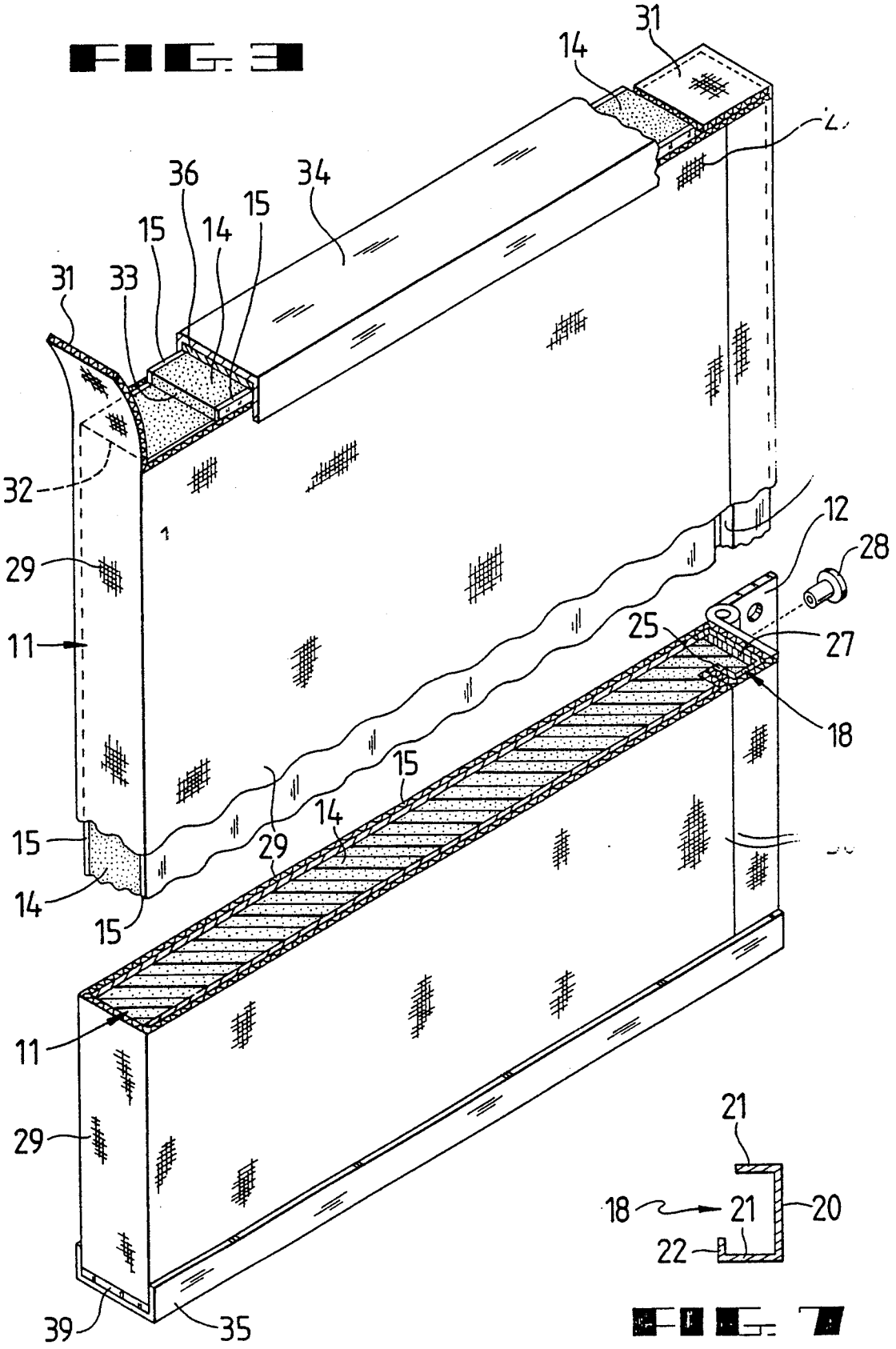
FIG. 3 is a perspective view of the present invention partly in section.
FIG. 7 is a sectional view of a structural member removed from its associated panel.
Figure 4:
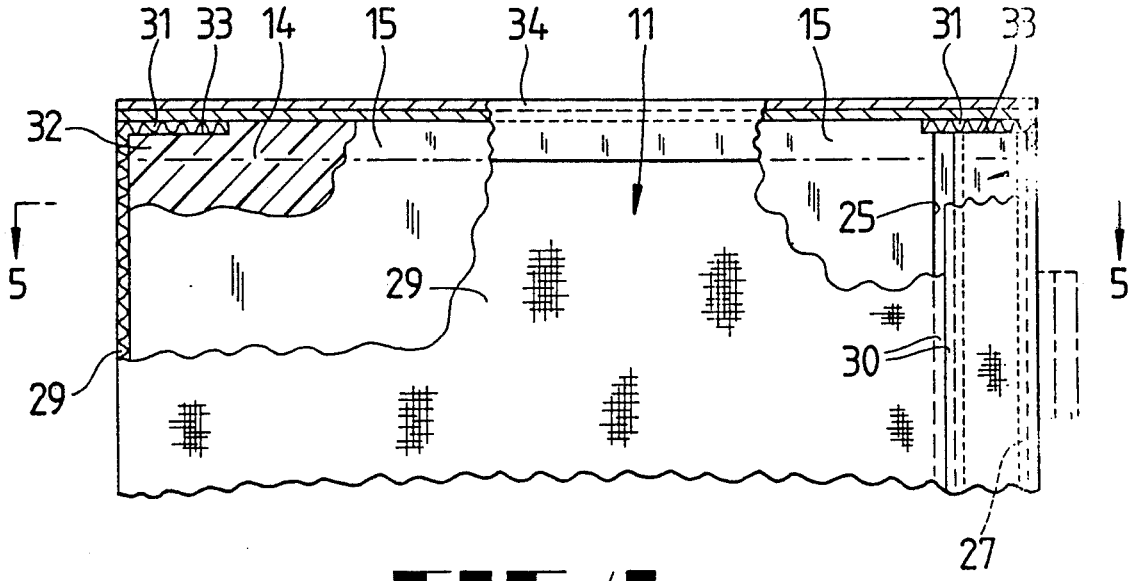
FIG. 4 is a fragmental front elevational view of the present invention partially broken away.
Figure 5:
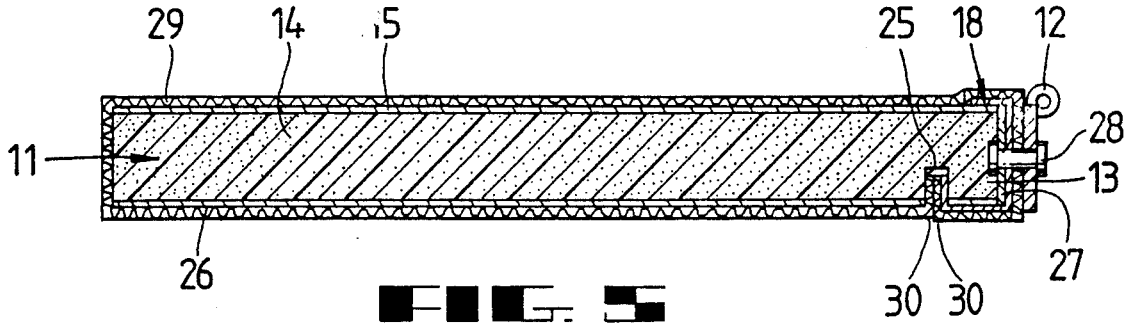
FIG. 5 is a sectional view taken along line 5—5 of FIG. 4.

Referring to the drawings for a clearer understanding of the invention, it should be noted that the present invention contemplates the use of a plurality of lightweight rectangular panels 11. As shown in FIGS. 1 and 2, the panels 11 are pivotally connected to one another by a plurality of hinges 12 secured to a lateral marginal edge 13 of each panel 11. Each panel 11 is constructed of a polystyrene core 14 secured intermediate two rigid pressboard side panels 15 such as is typical of the material known as "gatorboard". This construction provides a panel 11 that is lightweight but surprisingly strong. However, neither the polystyrene core 14 nor the pressboard side panels 15 are adequate for direct connection of the hinges 12 so a frame member 18 is secured to the lateral marginal edge 13 of each panel 11 for connection with the hinges 12. The frame member 18 comprises a channel which extends and receives therein the entire vertical length of the lateral marginal edge 13 of panel 11. As shown in FIGS. 3, 5 and 7, the channel is defined by a base 20 which fits in co-planar orientation to the lateral marginal edge 13 of the panel 11. Extending perpendicular to the base 20 in flanking relation to the lateral marginal edge 13 of the panel 11 are two side members 21. Extending inward in perpendicular connection to one side member 21, is a clasping edge 22 which is received within a vertical groove 25 located on a face 26 of the panel 11. The clasping edge 22 secures the frame member 18 on the panel 11. A rigid securing plate 27 extends in planar abutment with the lateral marginal edge 13 of the panel 11 and the base 20 of the frame member 18 being secured to both the base 20 and the lateral marginal edge 13 by adhesive. As shown in FIGS. 3 and 5, rivets 28 extend through hinge 12, base 20 and securing plate 27 consequently securing hinge 12 to the frame member 18 and securing plate 27. The securing plate 27 is preferably constructed of steel and prevents the rivets 28 from being pulled through the frame member 18 which is preferably constructed of a lightweight material such as aluminum. It should be obvious to the artisan that the frame member 18 could be constructed of a stronger metal such as steel, thereby eliminating the need for the securing plate 27, but in an effort to keep the present embodiment as lightweight as possible, the use of a lightweight frame member 18 together with the securing plate 27 is preferred. Each panel 11 is encompassed within a sheet of fabric 29 characteristic of the looped facing of hook-and-loop material. Each sheet of fabric 29 is wrapped one lateral rotation around the panel 11 and may be secured to the panel 11 with an adhesive. The lateral marginal edges 30 of each sheet 29 are positioned adjacent one another within the vertical groove 25, being held therein by the clasping edge 22 of the frame member 18. During assembly the sheet of fabric 29 is wrapped around the frame member 18 and the lateral marginal edges 30 are tucked intermediate the clasping edge 22 and the groove 25 in secured engagement therein. Each sheet of fabric 29 includes four tabs 31 connected to the upper and lower marginal edges of each sheet 29. When the sheet of fabric 29 is wrapped about the panel 11, each tab 31 extends beyond either an upper or lower end of the panel being positioned one on each corner 32 of the panel 11. Each corner 32 has formed thereon one of a plurality of recesses 33 which define the outermost extensions of the upper and lower edges of panel 11. The tabs 31 are secured within the recesses 33, each extending inwardly from a corner 32 of the panel 11. The tabs 31 aid in positioning the sheet of fabric 29 on the panel 11 during assembly and once secured, prevent the fabric 29 from shifting on the panel 11.

Figure 6:
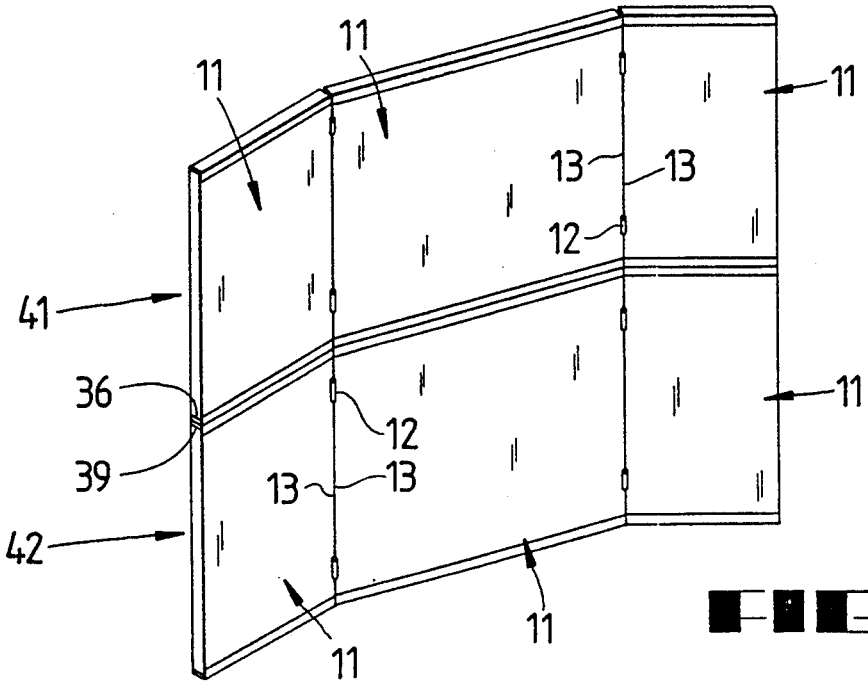
FIG. 6 is a perspective view of two sets of hinged panels engaged in vertical orientation of one another.

Each panel 11 may support an upper channel member 34 which co-extends and receives the upper marginal edge of the panel 11 and a lower channel member 35 which co-extends and encompasses the lower marginal edge of the panel 11. Each upper channel member 34 may include an upper securing strip 36 which is co-extensive with said upper channel member 34 and is magnetically attractive to a lower securing strip 39 co-extensive with the lower channel member 35. The upper securing strip 36 of one panel will magnetically engage the lower securing strip 39 of another panel when placed in vertical abutment thereon. As shown in FIG. 6, a first set of hinged panels 41 may be placed in secured vertical orientation atop a second set of hinged panels 42, being held in place by the upper and lower securing strips 36 and 39.

As shown in FIG. 1, advertising copy 43 is secured to the panels 11 by attaching portions of fabric 44 characteristic of the hooked facing of hook-and-loop adhesive material to the back of such copy 43. The portions of hooked fabric 44 will detachably engage the sheets of looped fabric 29 encompassing the panels 11 thereby securing the items of advertisement 43 to the panels 11. By using the hook-and-loop fabrics as adhesive, the advertising copy 43 can be engaged and disengaged from the panels 11 without damaging such items 43 or detracting from their visual continuity.

While we have shown our invention in various forms, it will be obvious to those skilled in the art that it is not so limited but is susceptible of various changes and modifications without departing from the spirit thereof.

I claim:

1. A display for advertisement comprising a plurality of lightweight panels pivotally secured to one another by a plurality of hinges mounted intermediate a plurality of channel members which co-extend and receive therein a lateral marginal edge of one of said plurality of panels, wherein said channel member comprises a base, two sides connected in perpendicular relation to said base and a clasping edge connected to either of said sides in perpendicular extension therefrom, said clasping edge being securably engaged within a clasping groove located in an adjacent face of said panel.

2. An advertising display as described in claim 1 wherein said panels are constructed of a strong but lightweight multicellular core intermediate two rigid outer panels.

3. Display as described in claim 1 wherein said hinges are fixably secured to said channel members by rivets.

4. Display as described in claim 1 wherein said panels are sheathed in fabric characteristic of the looped facing of hook-and-loop adhesive material.

5. Display as described in claim 1 wherein said panels are secured to other panels placed in vertical abutment thereon by means connected to the upper and lower marginal edges of each said panel.

6. Display as described in claim 5 wherein said means for securing comprises a plurality of upper channel members which co-extend and engage the upper marginal edge of selected ones of said plurality of panels and a plurality of lower channel members which co-extend and engage the lower marginal edge of selected other ones of said plurality of panels wherein said upper channel members magnetically attract said lower channel members.

7. An advertising display as described in claim 1 wherein each panel of said plurality of panels is encompassed within a sheet of fabric characteristic of the looped facing of hook-and-loop material.

8. An advertising display as described in claim 7 wherein each sheet of fabric includes a plurality of tabs, wherein each tab is located proximate a corner of said panel, in secured planar abutment with a marginal edge of said panel.

9. An advertising display as described in claim 7 wherein said sheet of fabric is connected to said panel with an adhesive.

10. Display as described in claim 1 comprising a rigid backing plate extending the length of said channel member in planar abutment with said base and said lateral marginal edge of said panel, wherein said backing plate is secured to said channel member by a plurality of rivets extending therethrough.

11. Display as described in claim 10 wherein said backing plate is secured to said base with adhesive.

12. Display as described in claim 10 wherein said backing plate is secured to said lateral marginal edge of said panel with adhesive.

13. An advertising display for the exhibition of signs, placards and leaflets, comprising:

(a) a plurality of lightweight rectangular panels adapted for mounting signs, placards and leaflets thereon;

(b) a plurality of hinges mounted intermediate said panels for securing each panel to an adjacent panel; and (c) means connected to said panels for mounting said hinges to said panels including a vertical groove proximate and parallel a lateral marginal edge of each panel of said plurality of panels and a channeled frame member extending and receiving therein said lateral marginal edge of each said panel, said frame member being engaged within said groove and defining a clasping channel extending the length of said frame member for receiving therein said lateral marginal edge of said panel and comprising a securing lip extending inwardly from a side of said channel within said vertically extending groove.

14. An advertising display as described in claim 13 wherein said mounting means further comprises a rigid securing plate located intermediate said frame member and said lateral marginal edge of said panel.

15. An advertising display as described in claim 14 further comprising a plurality of rivets extending through said securing plate, said frame member and said hinges which secure said hinges in adjacent contact to said frame member.

16. An advertising display as described in claim 13 wherein each panel of said plurality of panels is encompassed within a sheet of fabric characteristic of the looped facing of hook-and-loop material.

17. An advertising display as described in claim 16 wherein each said sheet of fabric extends one rotation around said panel, the lateral marginal edges of said sheet of fabric being secured adjacent one another within said vertically extending groove.

18. An advertising display as described in claim 13 further comprising means mounted on said panels for connecting said panels atop vertically adjacent panels.

19. An advertising display as described in claim 18 wherein said means for connecting comprises:

(a) a plurality of upper channel members, each co-extending and receiving therein an upper marginal edge of selected ones of said plurality of panels; and (b) a plurality of lower channel members, each co-extending and receiving therein a lower marginal edge of selected ones of said plurality of panels, wherein said upper channel member of each said selected one is capable of detachable engagement with said lower channel members of an adjacent selected other one when said lower channel member is placed in resting abutment atop said upper channel member.

20. An adverting display for the exhibition of signs, placards and leaflets, comprising:

(a) a plurality of lightweight rectangular panels adapted for mounting signs, placards and leaflets thereon;

(b) a plurality of hinges mounted intermediate said panels for securing each panel to an adjacent panel;

(c) means connected to said panels for mounting said hinges to said panels; and (d) means mounted to said panels for connecting said panels atop vertically adjacent panels; wherein said means for connecting includes a plurality of upper channel members, each co-extending and receiving therein an upper marginal edge of selected ones of said plurality of panels; and a plurality of lower channel members, each co-extending and receiving therein a lower marginal edge of selected ones of said plurality of panels, wherein said upper channel member of each said selected one is capable of detachable engagement with said lower channel members of an adjacent selected other one when said lower channel member is placed in resting abutment atop said upper channel member and wherein said means for connecting further comprises a plurality of magnetic strips connected to said upper channel members and a plurality of ferrous strips connected to said lower channel members.

* * * * *